US008359776B2

(12) United States Patent
Toles et al.

(10) Patent No.: US 8,359,776 B2
(45) Date of Patent: Jan. 29, 2013

(54) SIGN HOLDER FOR AN ELECTRONIC KIOSK

(75) Inventors: Katia L. J. Toles, Minneapolis, MN (US); Tracy M. Tonnessen, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 113 days.

(21) Appl. No.: 13/032,999

(22) Filed: Feb. 23, 2011

(65) Prior Publication Data

US 2012/0210618 A1 Aug. 23, 2012

(51) Int. Cl.
*G09F 3/18* (2006.01)

(52) U.S. Cl. ..... 40/661.08; 40/606.19

(58) Field of Classification Search ..... 40/606.19, 40/661.08, 661.03; 248/442.2
See application file for complete search history.

(56) References Cited

U.S. PATENT DOCUMENTS

| | | | | | |
|---|---|---|---|---|---|
| D167,162 | S | | 7/1952 | Polledo | |
| 3,464,135 | A | * | 9/1969 | Eidinger | 40/701 |
| 4,869,565 | A | | 9/1989 | Bachman | |
| 4,960,257 | A | | 10/1990 | Waters | |
| 5,104,087 | A | | 4/1992 | Wentzloff et al. | |
| 5,125,612 | A | | 6/1992 | McNeal | |
| 5,271,593 | A | | 12/1993 | Kinner et al. | |
| 5,388,353 | A | * | 2/1995 | Givnan | 40/737 |
| 5,533,702 | A | | 7/1996 | Koch | |
| 5,564,209 | A | * | 10/1996 | Zagnoli | 40/594 |
| D392,682 | S | | 3/1998 | Johnston et al. | |
| 5,725,191 | A | | 3/1998 | Nemeth | |
| 5,769,374 | A | | 6/1998 | Martin et al. | |
| 5,881,986 | A | | 3/1999 | Hegarty | |
| 5,890,309 | A | | 4/1999 | Markarian | |
| 5,901,937 | A | | 5/1999 | Compeau et al. | |
| 5,988,582 | A | | 11/1999 | Olivo | |
| D445,109 | S | | 7/2001 | Tracy | |
| 6,263,603 | B1 | * | 7/2001 | Wildrick | 40/661 |
| D447,750 | S | | 9/2001 | Bell | |
| 6,412,744 | B1 | * | 7/2002 | Wollam et al. | 248/442.2 |
| D461,190 | S | | 8/2002 | Bell | |
| D471,200 | S | | 3/2003 | Bell | |
| 6,533,236 | B1 | | 3/2003 | MacLellan et al. | |
| 6,543,168 | B1 | | 4/2003 | Moore | |
| 6,594,144 | B1 | | 7/2003 | Miles | |
| 6,851,656 | B2 | | 2/2005 | Bauman et al. | |
| D508,054 | S | | 8/2005 | Ramsey | |
| D547,757 | S | | 7/2007 | Koo | |
| 7,325,340 | B2 | | 2/2008 | Chen | |
| 7,340,855 | B2 | | 3/2008 | Wiltfang et al. | |
| 7,611,117 | B1 | | 11/2009 | Lang, Jr. | |
| 7,681,856 | B1 | | 3/2010 | Thomas et al. | |
| D621,407 | S | | 8/2010 | Simonsen | |
| D624,323 | S | | 9/2010 | Simonsen | |
| 7,823,856 | B2 | | 11/2010 | Schwartz et al. | |
| 2002/0066846 | A1 | * | 6/2002 | Giulie et al. | 248/442.2 |
| 2004/0031899 | A1 | | 2/2004 | Costa et al. | |
| 2006/0091280 | A1 | | 5/2006 | Rothschild | |
| 2007/0119079 | A1 | | 5/2007 | Dill | |

* cited by examiner

*Primary Examiner* — Joanne Silbermann
*Assistant Examiner* — Kristina Junge
(74) *Attorney, Agent, or Firm* — Leanne Taveggia Farrell; Westman, Champlin & Kelly, P.A.

(57) ABSTRACT

A sign holder includes a base, a first sign sleeve and at least one second sign sleeve. The base has a mounting portion configured to mount to an electronic kiosk, a sleeve support portion and a connecting portion coupling the mounting portion to the sleeve support portion. The first sign sleeve receives at least one sign and is mounted to a front surface of the sleeve support portion and the at least one second sign sleeve receives at least one sign and is mounted to a front surface of the first sign sleeve.

19 Claims, 10 Drawing Sheets

SIGN HOLDER FOR AN ELECTRONIC KIOSK

BACKGROUND

An electronic kiosk houses a computing device having a display and a means of accepting user input. Kiosks are placed in high foot traffic settings and allow a user to perform a wide variety of self-service activities. For example, Internet kiosks provide users public Internet access, ticketing kiosks provide users with the ability to purchase tickets for specific services, such as travel and etc., vending kiosks provide users with products for purchase or rental and photo kiosks allow users to print pictures from digital images and/or order photo prints and other photographic products.

The discussion above is merely provided for general background information and is not intended to be used as an aid in determining the scope of the claimed subject matter.

SUMMARY

A sign holder includes a base or backer, a first sign sleeve or casing and at least one second sign sleeve or casing. The base has a mounting portion configured to mount to an electronic kiosk, a sleeve support portion and a connecting portion coupling the mounting portion to the sleeve support portion. The first sign sleeve receives at least one first sign and is mounted to a front surface of the sleeve support portion and the at least one second sign sleeve receives at least one second sign and is mounted to a front surface of the first sign sleeve.

In one embodiment, the base is formed of a single, continuous material and includes a first bend that defines a mounting portion and a connecting portion and a second bend that defines the connecting portion and a sleeve support portion The first sign sleeve and the at least one second sign sleeve include front pieces, back pieces and bottom connecting pieces coupling the front pieces to the back pieces. Top edges of the corresponding front and back pieces bias together.

A method of displaying at least one sign on an electronic kiosk is also provided. A portion of the mounting portion of the base is downwardly slid between a back surface of a kiosk display monitor and a support arm supporting the kiosk display monitor until the sleeve support portion is located above a top surface of the kiosk display monitor. The at least one first sign is inserted into the first sign sleeve and the top edges of the first sign sleeve bias together to retain the at least one first sign.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION OF ILLUSTRATIVE EMBODIMENTS

Embodiments are described as a sign holder for mounting to an electronic kiosk. The sign holder includes multiple components coupled together for supporting signs. In particular, the sign holder includes a base, a first sign sleeve and at least one second sign sleeve. The first sign sleeve and the at least one second sign sleeve couple together and attach to the base. The base includes features for mounting the sign holder to the electronic kiosk.

An electronic kiosk houses a computing device having a display and a means of accepting user input. In particular, electronic kiosks can be placed in retail stores to perform a variety of self-service activities including, for example, providing a self-service point-of-sale (POS) system. In another application, photo electronic kiosks can be placed in retail stores to perform a variety of photo-making activities. For example and based on user input, such electronic kiosks can print pictures from digital images and/or order and pay for photo prints and other photographic products.

Figure 1:
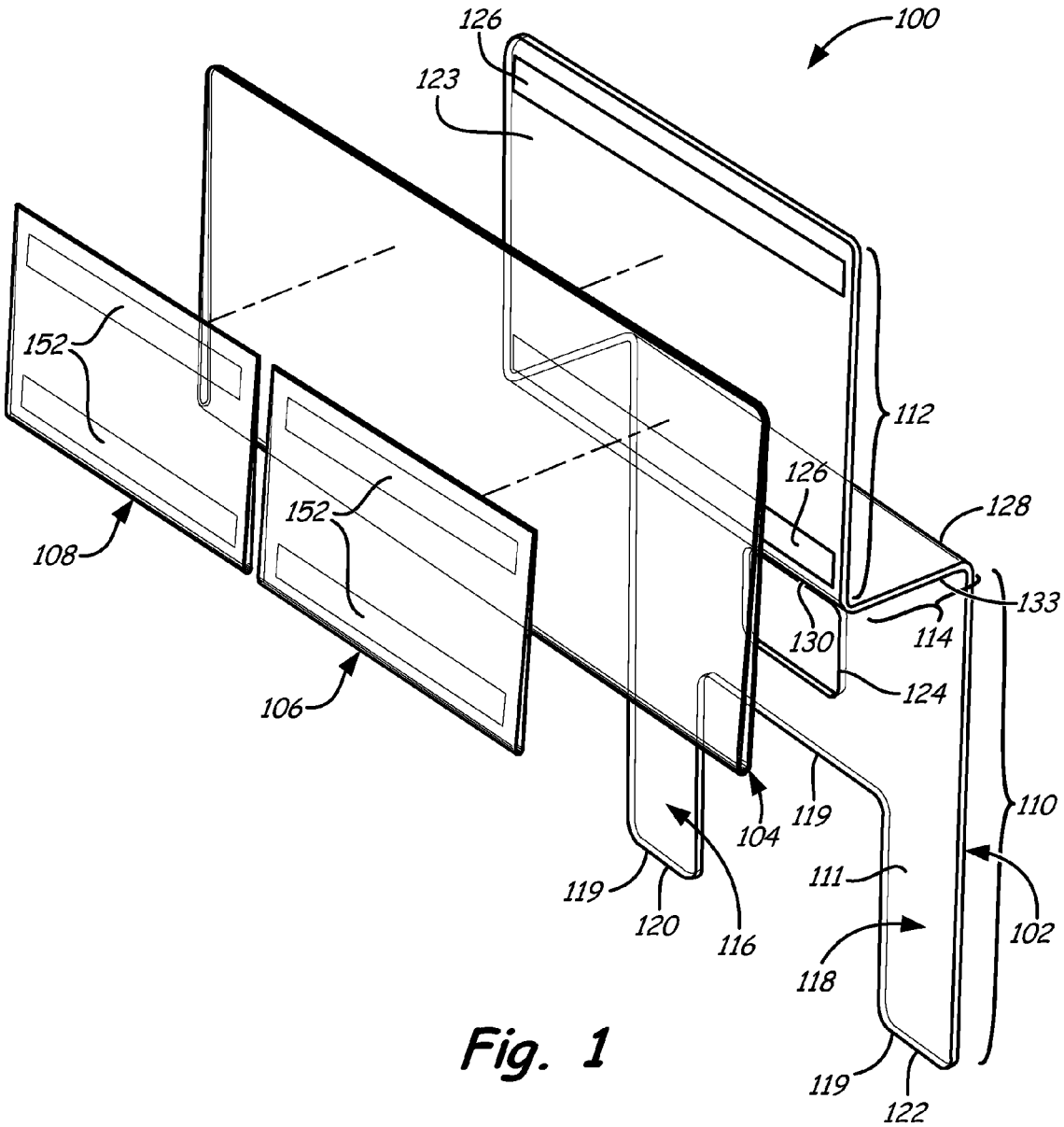
FIG. 1 illustrates an exploded view of a sign holder in accordance with one embodiment.
Figure 2:
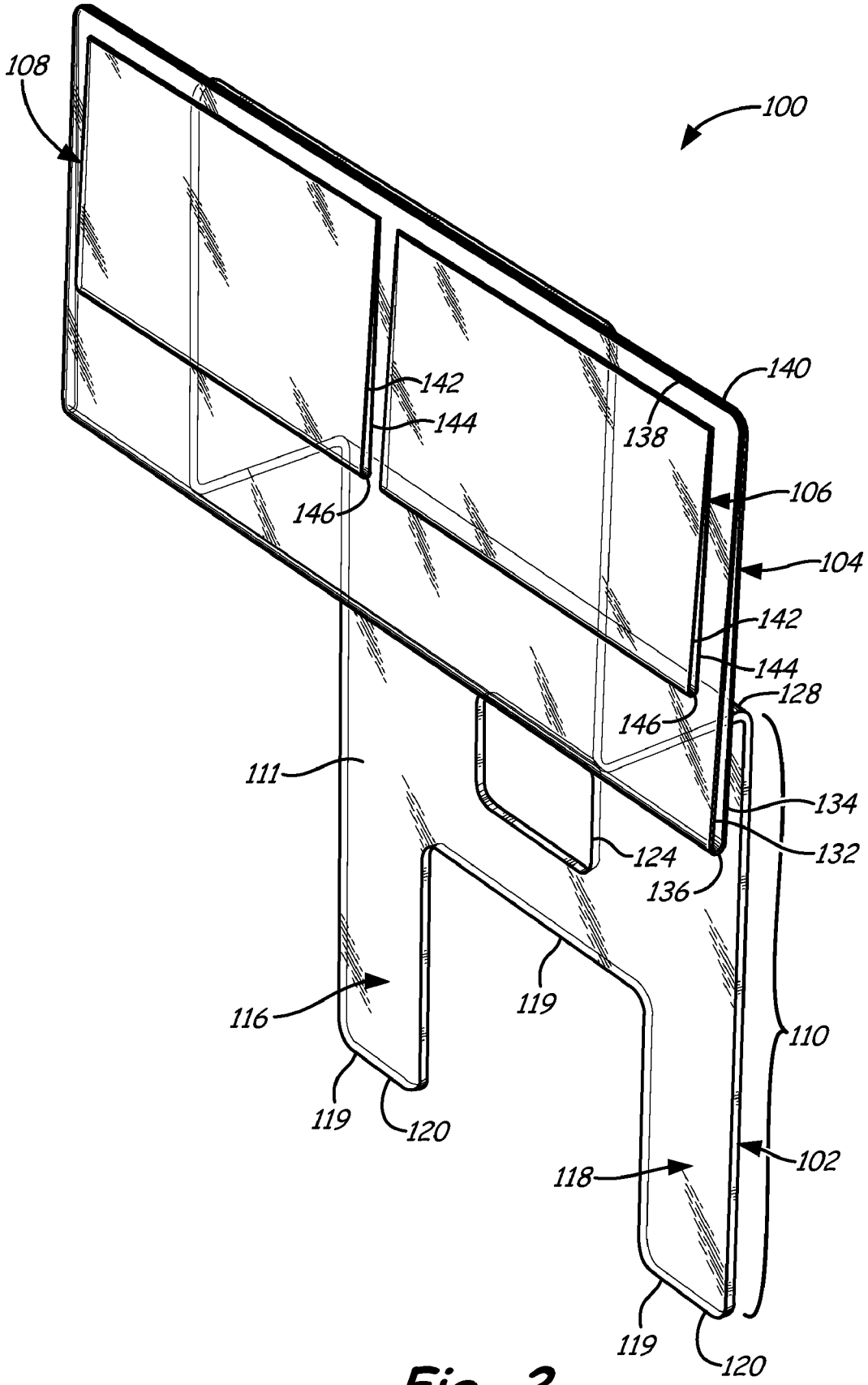
FIG. 2 illustrates a perspective view of the sign holder illustrated in FIG. 1 as assembled.

FIG. 1 illustrates an exploded view of a sign holder 100 in accordance with one embodiment. FIG. 2 is a perspective view of assembled sign holder 100, while FIGS. 3-8 illustrate elevation views of the assembled sign holder. Sign holder 100 includes a base or backer 102, a first sign sleeve or casing 104 and at least two second sign sleeves or casings 106, 108. Although a pair of second sign sleeves or casings are shown, other embodiments will have more or fewer second sign sleeves or casings. In accordance with one embodiment, each of base 102, first sign sleeve 104 and the pair of second sign sleeves 106 and 108 are at least partially transparent. For example, each of base 102, first sign sleeve 104 and the pair of second sign sleeves 106 and 108 may be made of transparent plastic, such as transparent polyethylene terephthalate glycol (PETG). However, other types of materials including other types of plastics may be used.

Figure 7:
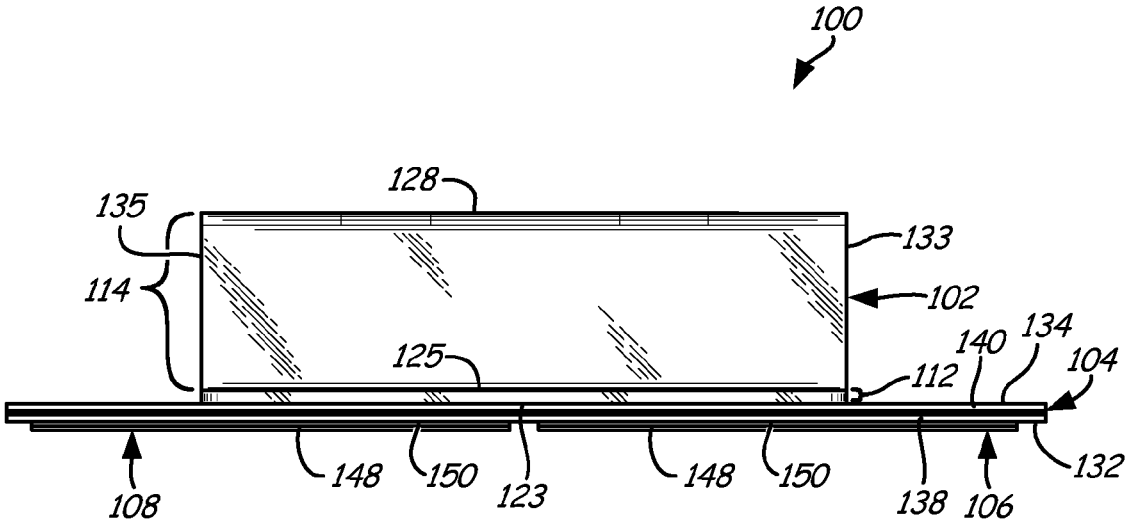
FIG. 7 illustrates a top view of the sign holder illustrated in FIG. 2.
Figure 8:
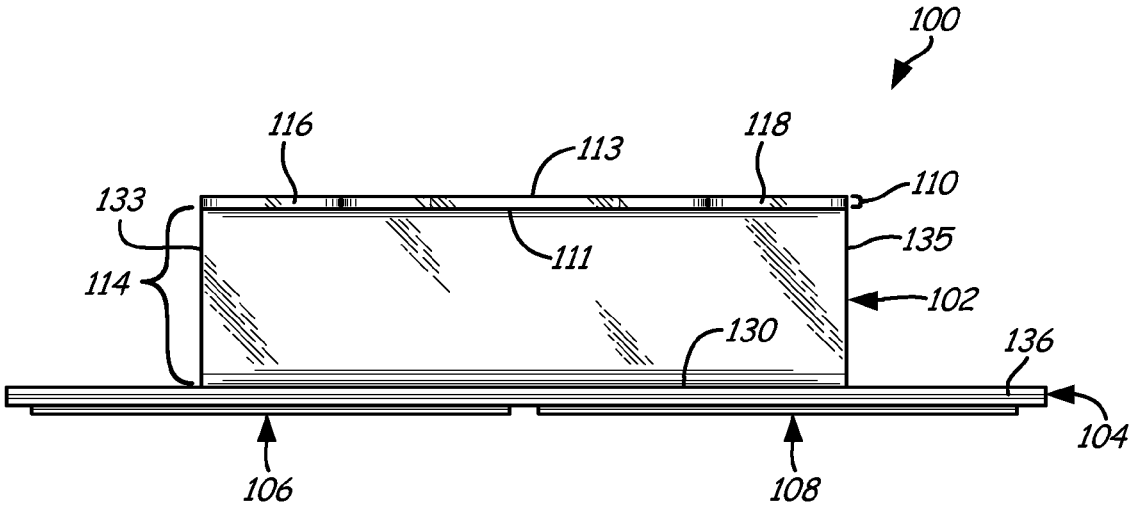
FIG. 8 illustrates a bottom view of the sign holder illustrated in FIG. 2.
Figure 9:
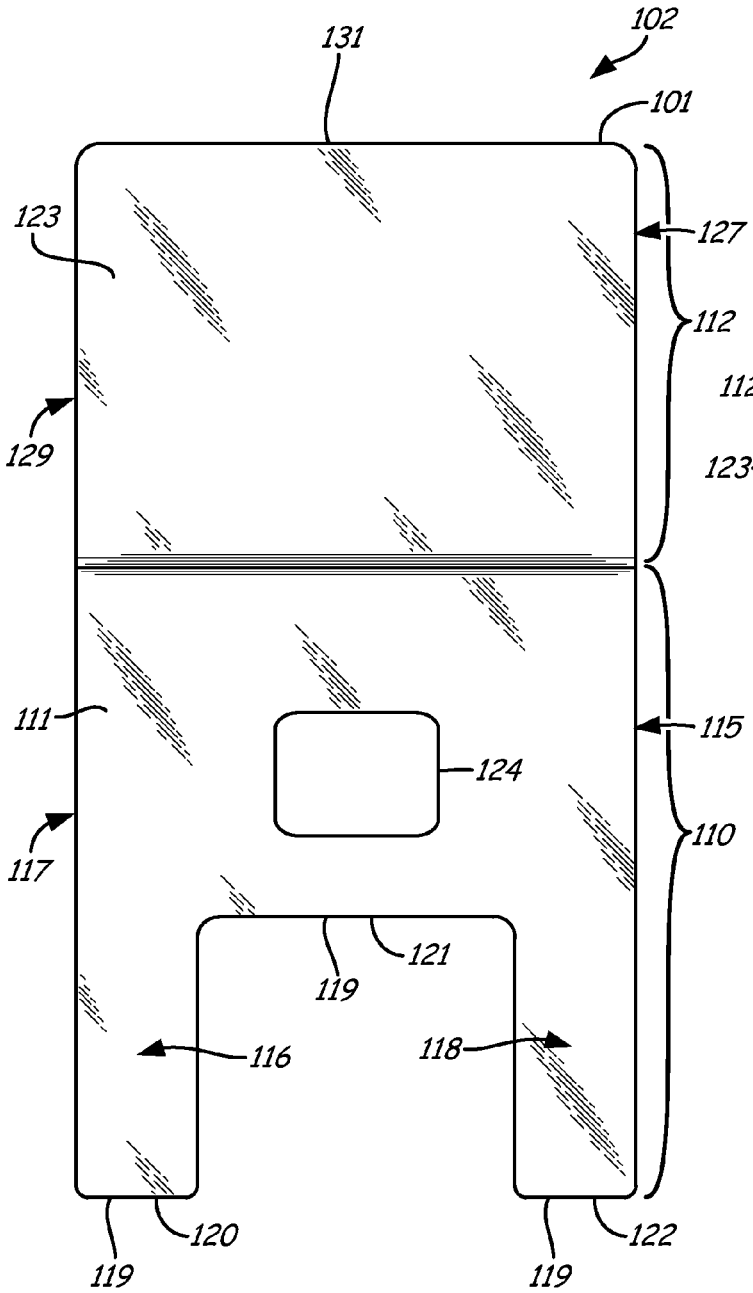
FIG. 9 illustrates a front view of a mounting portion of the sign holder illustrated in FIG. 2.
Figure 10:
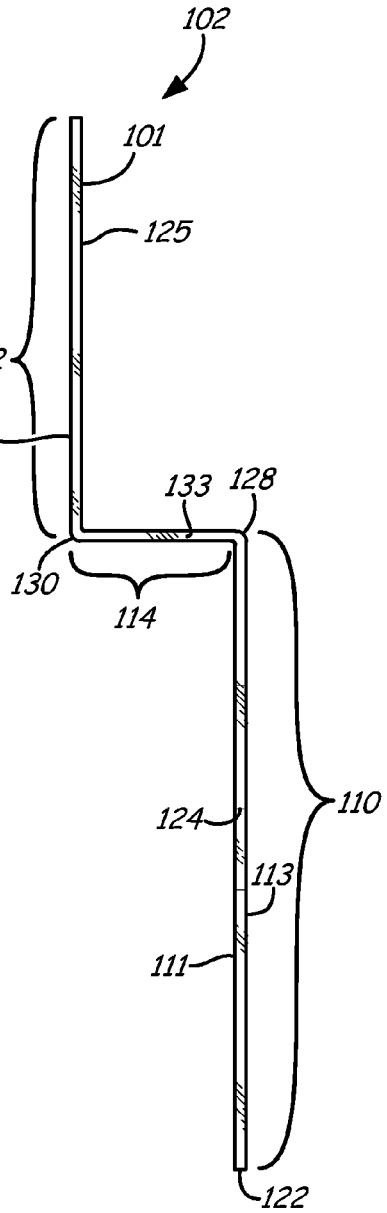
FIG. 10 illustrates a right side view of the mounting portion of the sign holder illustrated in FIG. 9.

While FIGS. 2-8 illustrate base 102 assembled with other components of sign holder 100, FIG. 9 illustrates a front view of only base 102 and FIG. 10 illustrates a side view of only base 102. In one embodiment and as illustrated in FIGS. 1-10, base 102 is formed of a single, integral or continuous material 101, such as the transparent plastic discussed above. However, in other embodiments, base 102 can be formed of multiple pieces of material. Base 102 includes a mounting portion 110, a sleeve or casing support portion 112 and a connecting portion 114 coupling the mounting portion 110 to the sleeve support portion 112.

Figure 6:
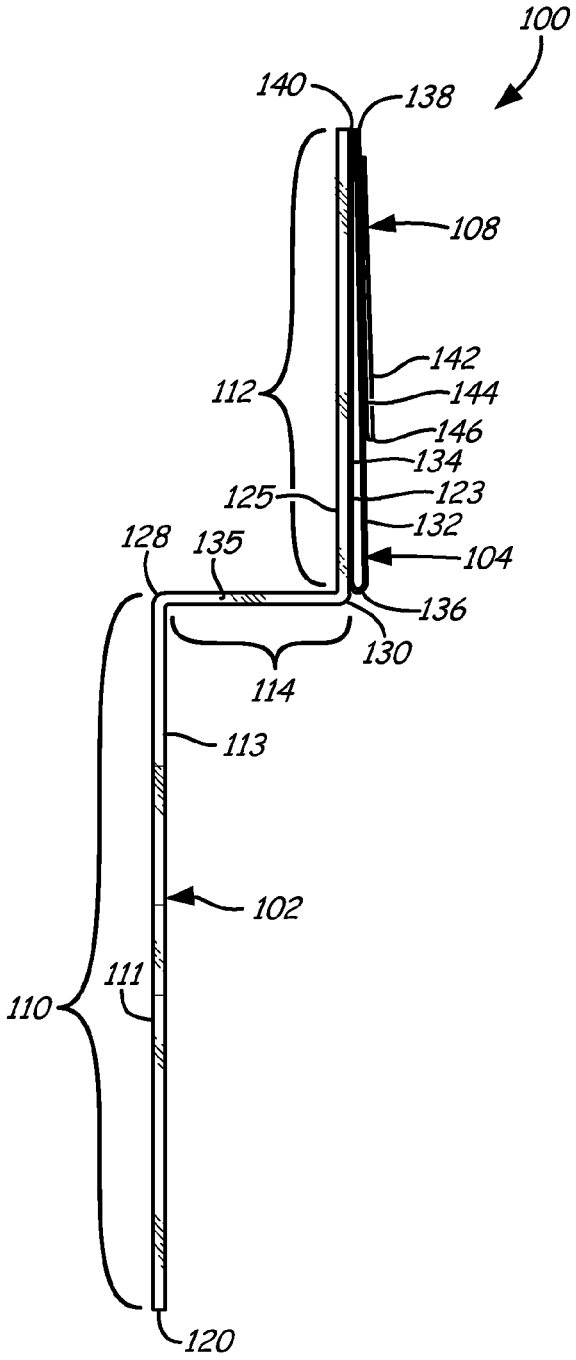
FIG. 6 illustrates a left side view of the sign holder illustrated in FIG. 2.

In the embodiment illustrated in FIGS. 1-10, connecting portion 114 is defined by a first bend edge 128 (FIGS. 1-2, 4-6 and 10), a second bend edge 130 (FIGS. 1, 5-6 and 10), a right side edge 133 (FIGS. 1, 5, 7-8 and 10) and a left side edge 135 (FIGS. 6-8). More specifically, the single, continuous material 101 of base 102 is bent along first bend edge 128, which defines a top edge of mounting portion 110 and an edge of connecting portion 114. As illustrated in FIG. 10, first bend edge 128 is bent at approximately a 90 degree angle such that a horizontal plane of connecting portion 114 is substantially perpendicular to a vertical plane of mounting portion 110. The single, continuous material 101 of base 102 is also bent along second bend edge 130, which defines a bottom edge of sleeve support portion 112 and an edge of connecting portion 114. Second edge 130 is bent at approximately a 90 degree angle such that the horizontal plane of connecting portion 114 is substantially perpendicular to a vertical plane of sleeve support portion 112.

Mounting portion 110 is configured to mount to an electronic kiosk. Mounting portion 110 includes a front surface 111 (FIGS. 1-3, 5-6 and 8-10) and an opposing back surface 113 (FIGS. 4-6, 8 and 10). In one embodiment and as illustrated in FIGS. 9 and 10, front surface 111 and back surface 113 are defined by a right side edge 115, a left side edge 117, bottom edges 119 and first bend edge 128. While right side edge 115 and left side edge 117 are continuous, linear extending edges that intersect with bottom edges 119 at rounded corners, bottom edges 119 are not continuous and include three edges. Together, bottom edges 119 define distal edges 120 and 122 of downwardly depending tabs 116 and 118 and an interior section 121. In other words, a height of tabs 116 and 118 is defined between the bottom edge 119 at distal ends 120 and 122 and bottom edge 119 at interior section 121, which is a spaced apart distance that extends between tabs 116 and 118 and their distal ends 120. Mounting portion 110 also includes an aperture 124 extending between the front surface 111 and the back surface 113 of mounting portion 110 and is located between bottom edge 119 and first bend edge 128.

Sleeve support portion 112 also extends along a substantially vertical plane and is configured to receive and support first sign sleeve or casing 104 and therefore also second sign sleeves or casings 106 and 108, which are coupled to first sign sleeve 104. Sleeve support portion 112 includes a front surface 123 (FIGS. 1, 5-7 and 9-10) and an opposing back surface 125 (FIGS. 4-7 and 10). In one embodiment and as illustrated in FIGS. 9 and 10, front surface 123 and back surface 125 are defined by a right side edge 127, a left side edge 129, a top edge 131 and second bend edge 130. Both right side edge 127 and left side edge 129 are continuous, linear extending edges that intersect with top edge 131 at rounded corners. More specifically, and in the embodiment illustrated in FIGS. 1-9, right side edge 127 extends continuous with and in alignment with right side edge 133 of connecting portion 114, which extends continuous with and in alignment with right side edge 115 of mounting portion 110. Left side edge 129 extends continuous with and in alignment with left side edge 135 of connecting portion 114, which extends continuous with and in alignment with left side edge 117 of mounting portion 110.

Mounted to front surface 123 of sleeve support portion 112 includes at least one fastener 126 (FIG. 1). At least one fastener 126 is configured to mount first sign sleeve 104 to sleeve support portion 112. For example, the at least one fastener 126 can be an adhesive, such as double-sided Tesa® tape. As illustrated in FIG. 1, sleeve support portion 112 includes two pieces of adhesive 126. The first piece of adhesive 126 is located proximate top edge 131 and the second piece of adhesive 126 is located proximate second bend edge 130.

First sign sleeve 104 is mounted to front surface 123 of sleeve support portion 112 via at least one adhesive 126. First sign sleeve 104 includes a front piece 132 coupled to a back piece 134 by a bottom connecting piece 136. In one embodiment, first sign sleeve 104 is made of a single, continuous material, such as the transparent plastic discussed above. In other words, the material of first sign sleeve 104 extends along front piece 132, turns at bottom connecting piece 136 and extends along back piece 134 such that bottom connecting piece 136 encloses the bottom of first sign sleeve 104 while a top, a right side and a left side of first sign sleeve 104 are open and provide access into the sleeve. Top edges 138 and 140 of both front piece 132 and back piece 134, respectively, bias together and therefore are directly in contact with each other when first sign sleeve is empty of a sign. However, the biased top edges 138 and 140 can be opened for inserting a first sign or a plurality of first signs. Once at least one first sign is inserted, top edges 138 and 140 of the corresponding front and back pieces 132 and 134 of the first sign sleeve 104 bias together to retain the at least one first sign in place.

Figure 3:
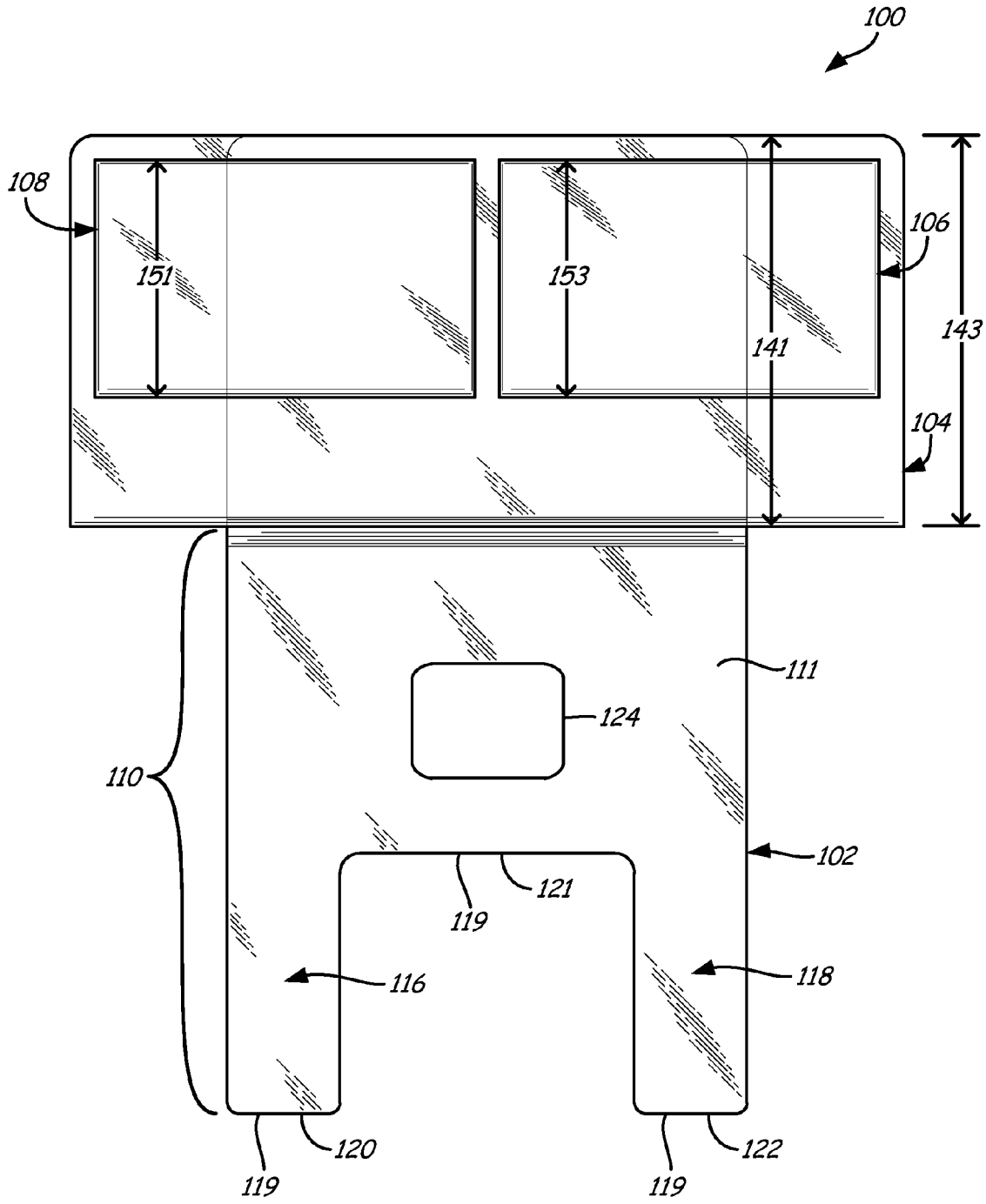
FIG. 3 illustrates a front view of the sign holder illustrated in FIG. 2.
Figure 4:
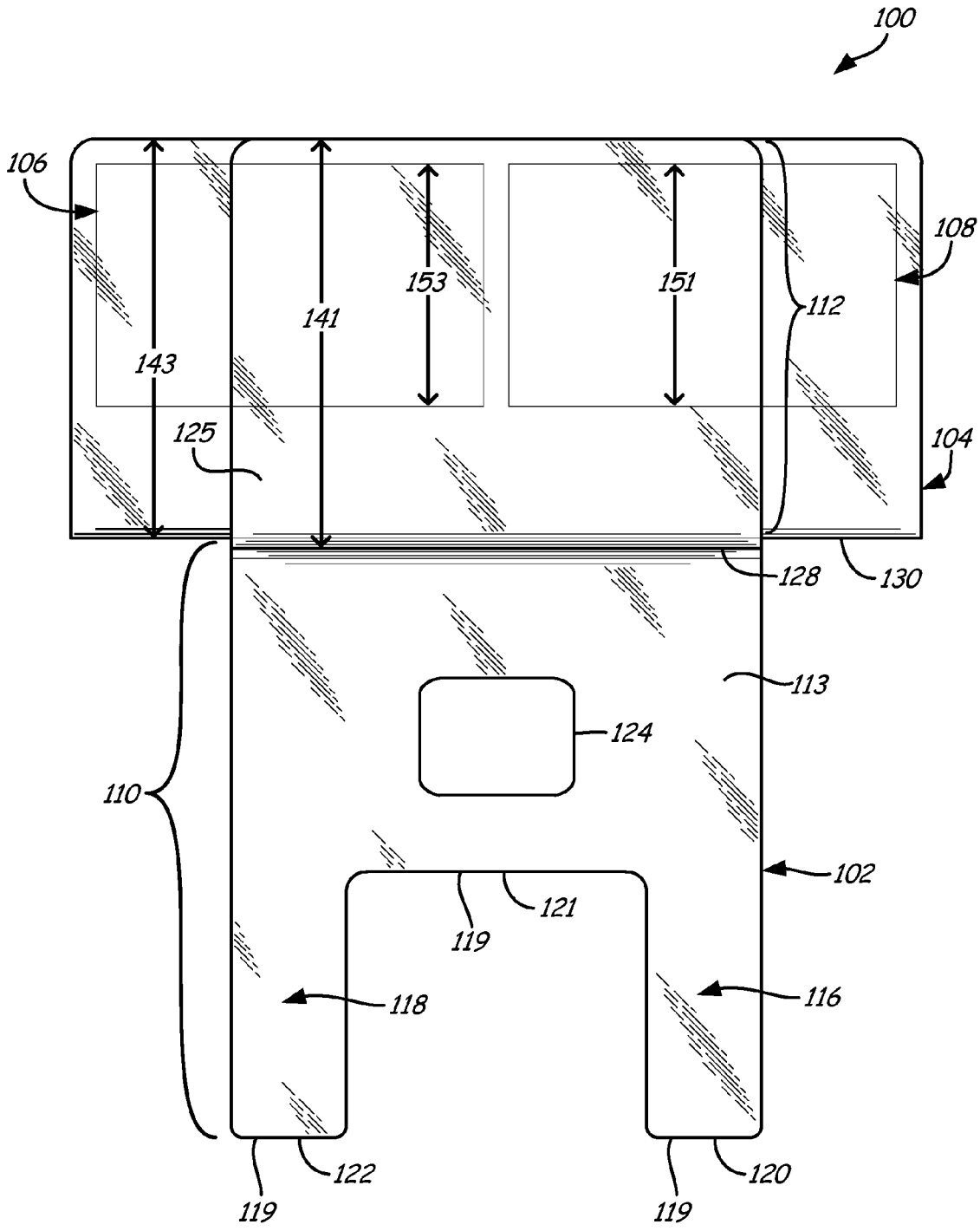
FIG. 4 illustrates a back view of the sign holder illustrated in FIG. 2.
Figure 5:
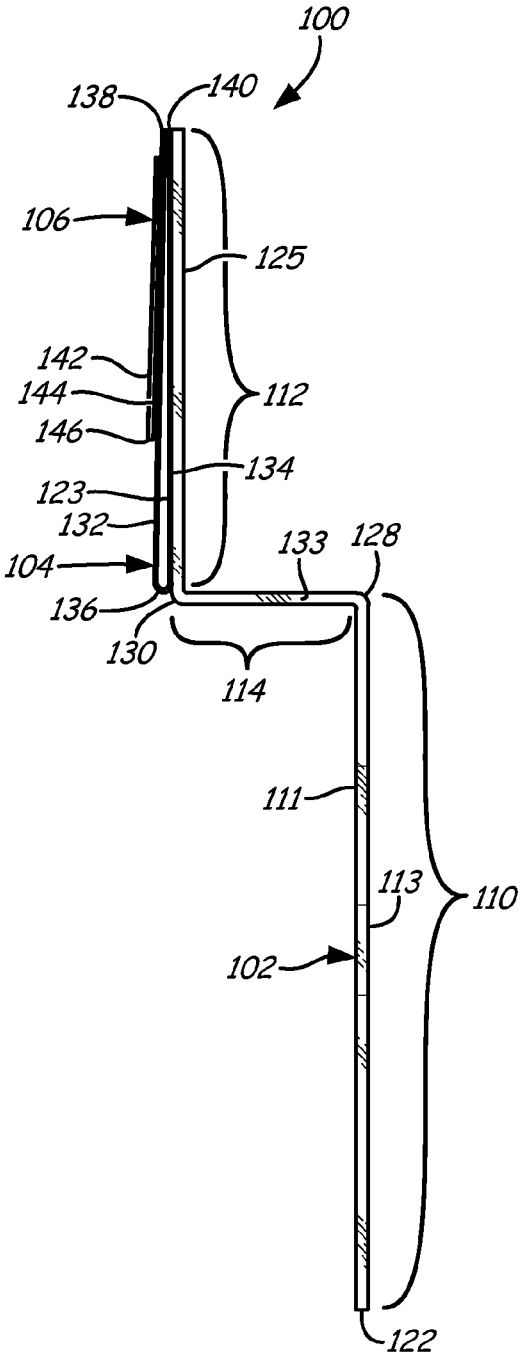
FIG. 5 illustrates a right side view of the sign holder illustrated in FIG. 2.

As shown in the embodiment illustrated in FIGS. 1-8 and more specifically in FIGS. 3 and 4, a height 141 of sleeve support portion 112 substantially corresponds with a height 143 of first sign sleeve 104. For example, first sign sleeve 104 may include dimensions for accommodating a 5 inch×11 inch sign. Therefore, height 141 of sleep support portion 112 can be approximately 5.20 inches and height 143 of first sign sleeve 104 may be approximately 5.10 inches in some embodiments.

Each of the pair of second sign sleeves 106 and 108 includes a front piece 142 coupled to a back piece 144 by a bottom connecting piece 146. In one embodiment, each of the pair of second sign sleeves 106 and 108 is made of a single, continuous material, such as the transparent plastic discussed above. In other words, the material for each of the pair of second sign sleeves 106 and 108 extends along front piece 142, turns at bottom connecting piece 146 and extends along back piece 144 such that bottom connecting piece 146 encloses the bottom of each of the second sign sleeves while a top, a right side and a left side of each of second sign sleeves 106 and 108 are open and provide access into each sleeve. Top edges 148 and 150 (FIG. 7) of front piece 142 and back piece 144 (FIGS. 5 and 6), respectively, of each of second sign sleeves 106 and 108 bias together and therefore are directly in contact with each other when the sleeves are empty of signs. However, the biased top edges 148 and 150 can be opened for inserting a second sign or a plurality of second signs. Once at least one second sign is inserted, top edges 148 and 150 of the corresponding front and back pieces 142 and 144 of the second sign sleeves 106 and 108 that the at least one sign is inserted into bias together to retain the at least one second sign in place.

As shown in the embodiment illustrated in FIGS. 1-8 and more specifically in FIGS. 3 and 4, heights 151 and 153 of the pair of second sign sleeves 106 and 108 are substantially similar to each other and are less than height 141 of sleeve support portion 112 and less than height 143 of first sign sleeve 104. For example, second sign sleeves 106 and 108 may include dimensions for accommodating a 3 inch×5 inch sign. Therefore, heights 151 and 153 of second sign sleeves 106 and 108 can be approximately 3.10 inches in some embodiments.

Coupled to a back surface of back piece 142 of each of the second sign sleeves 106 and 108 includes at least one fastener 152 (FIG. 1) for mounting each of the second sign sleeves 106 and 108 to first sign sleeve 104. For example, the at least one fastener 152 can be an adhesive, such as a transparent double-sided Tesa® tape. As illustrated in FIG. 1, each of second sign sleeves 106 and 108 include two pieces of adhesive 152. The first piece of adhesive 152 is located proximate top edges 148 and 150 and the second piece of adhesive 152 is located proximate bottom connecting piece 146.

Figure 11:
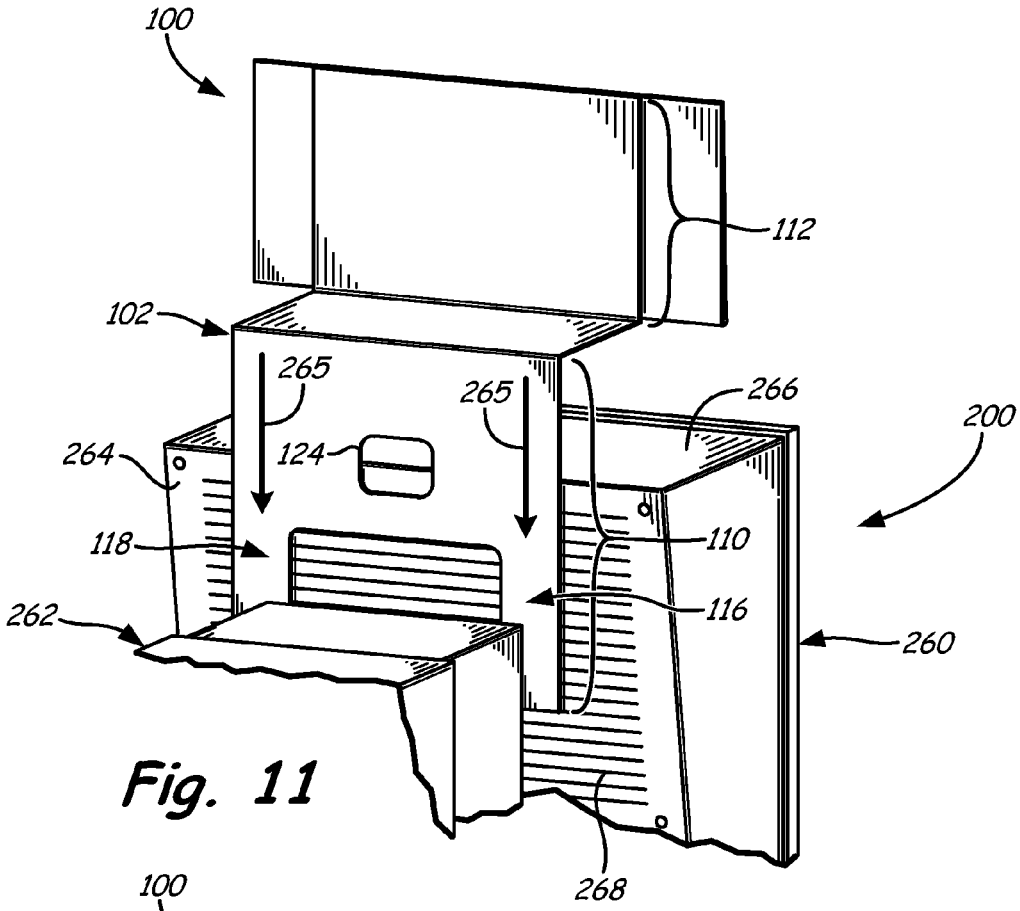
FIG. 11 illustrates a perspective view of the sign holder illustrated in FIG. 2 being mounted to an electronic kiosk.
Figure 12:
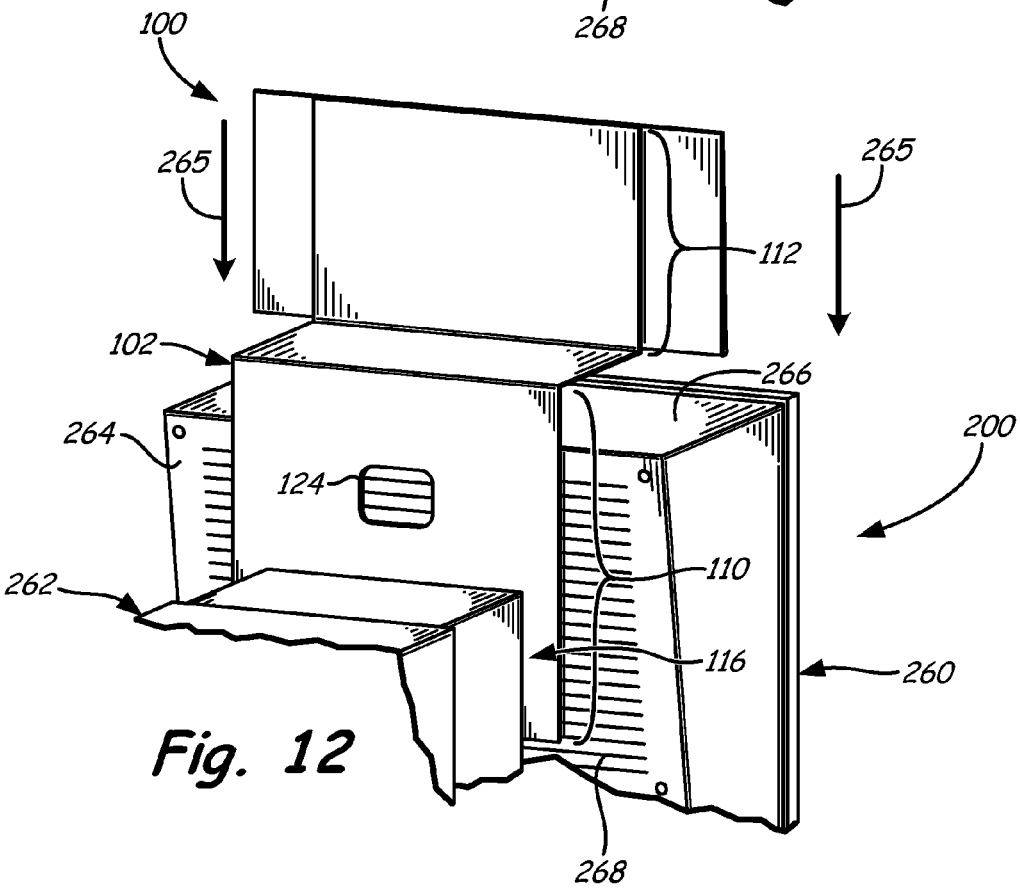
FIG. 12 illustrates a perspective view of the sign holder illustrated in FIG. 2 being mounted to an electronic kiosk.

FIGS. 11-15 illustrate various views of a method of displaying at least one sign on an electronic kiosk 200. Electronic kiosk 200 includes a kiosk display monitor 260, which is supported by a support arm 262. As illustrated, display monitor 260 includes a back surface 264 and a top surface 266. In FIGS. 11 and 12, opposite back surface 264 is a display screen that is hidden from view.

As illustrated in FIGS. 11 and 12, sign holder 100 is mounted to electronic kiosk 200 by downwardly sliding a portion of the mounting portion 110 of the base 102 between back surface 264 of display monitor 260 and a portion of support arm 262 until the sleeve support portion 112 is located above top surface 266 of display monitor 260. More specifically, sign holder 100 is mounted to electronic kiosk 200 by downwardly sliding the pair of tabs 116 and 118 of mounting portion 110 between back surface 264 of display monitor 260 and support arm 262 as illustrated by the arrows 265 in FIGS. 11 and 12. In FIG. 12, tabs 116 and 118 are set in place such that sleeve support portion 112 is located above top surface 266. With tabs 116 and 118 in place, mounting portion 110 of base 102 blocks some airflow between display monitor 260 and its external environment. Therefore, aperture 124 provides an opening that allows for the exchange of airflow such that monitor 260 can utilize vents 268 for cooling monitor 260.

Figure 13:
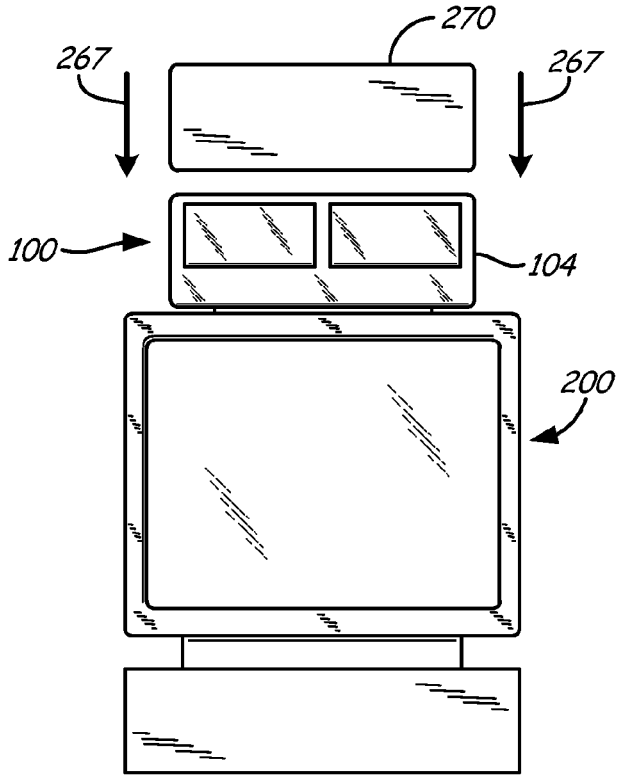
FIG. 13 illustrates a front view of at least one first sign being inserted into the sign holder illustrated in FIG. 2.

FIG. 13 illustrates a front view of electronic kiosk 200 including mounted sign holder 100. As illustrated in FIG. 13 and denoted by the arrows 267 in FIG. 13, at least one first sign 270 is being inserted into a first sign sleeve 104, which is mounted to a front surface of the sleeve support portion 112. At least one first sign 270 may be a decorative sign, including a wood grain pattern, which draws the attention of a user of the electronic kiosk. As illustrated, at least one first sign 270 is being inserted top down. However, at least one first sign 270 may also be inserted into first sign sleeve 104 from the right side or the left side. As previously described, the first sign sleeve 104 includes a front piece, a back piece and a bottom connecting piece coupling the front piece to the back piece. Top edges of the corresponding front and back pieces of the first sign sleeve bias together such that the top edges retain the at least one first sign 210 after it is inserted into first sign sleeve 104.

Figure 14:
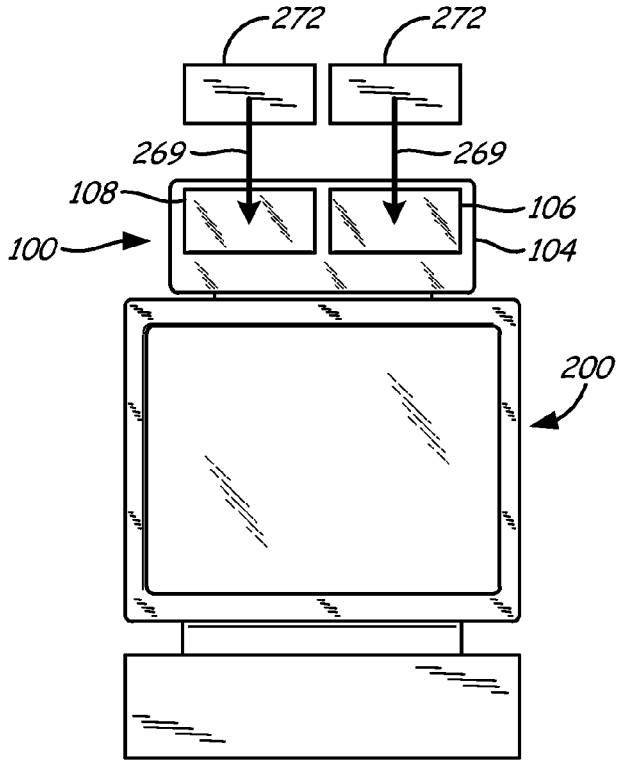
FIG. 14 illustrates a front view of at least one second sign being inserted into the sign holder illustrated in FIG. 2.

FIG. 14 illustrates a front view of electronic kiosk 200 including mounted sign holder 100. As illustrated in FIG. 14 and denoted by the arrows 269 in FIG. 14, two second signs 272 are each being inserted in a downward direction into one of two second sign sleeves 106, 108, which are mounted to a front surface of the first sign sleeve 104. Second signs 272 may include pricing information or promotional pricing information. As illustrated, second signs 272 are being inserted top down. However, second signs 272 may also be inserted into second sign sleeves 106, 108 from the right side or the left side. As previously described, the second sign sleeves 106 and 108 include a front piece, a back piece and a bottom connecting piece coupling the front piece to the back piece. Top edges of the corresponding front and back pieces of the pair of second sign sleeves 106 and 108 bias together such that the top edges retain the at least one second sign 272. While the embodiment illustrated in FIG. 14 shows the pair of second sign sleeves 106 and 108 mounted to the front surface of the first sign sleeve 104 and signs 272 being inserted top down, any number of second sign sleeves includes a single second sign sleeve can be mounted to the front surface of the first sign sleeve 104.

Figure 15:
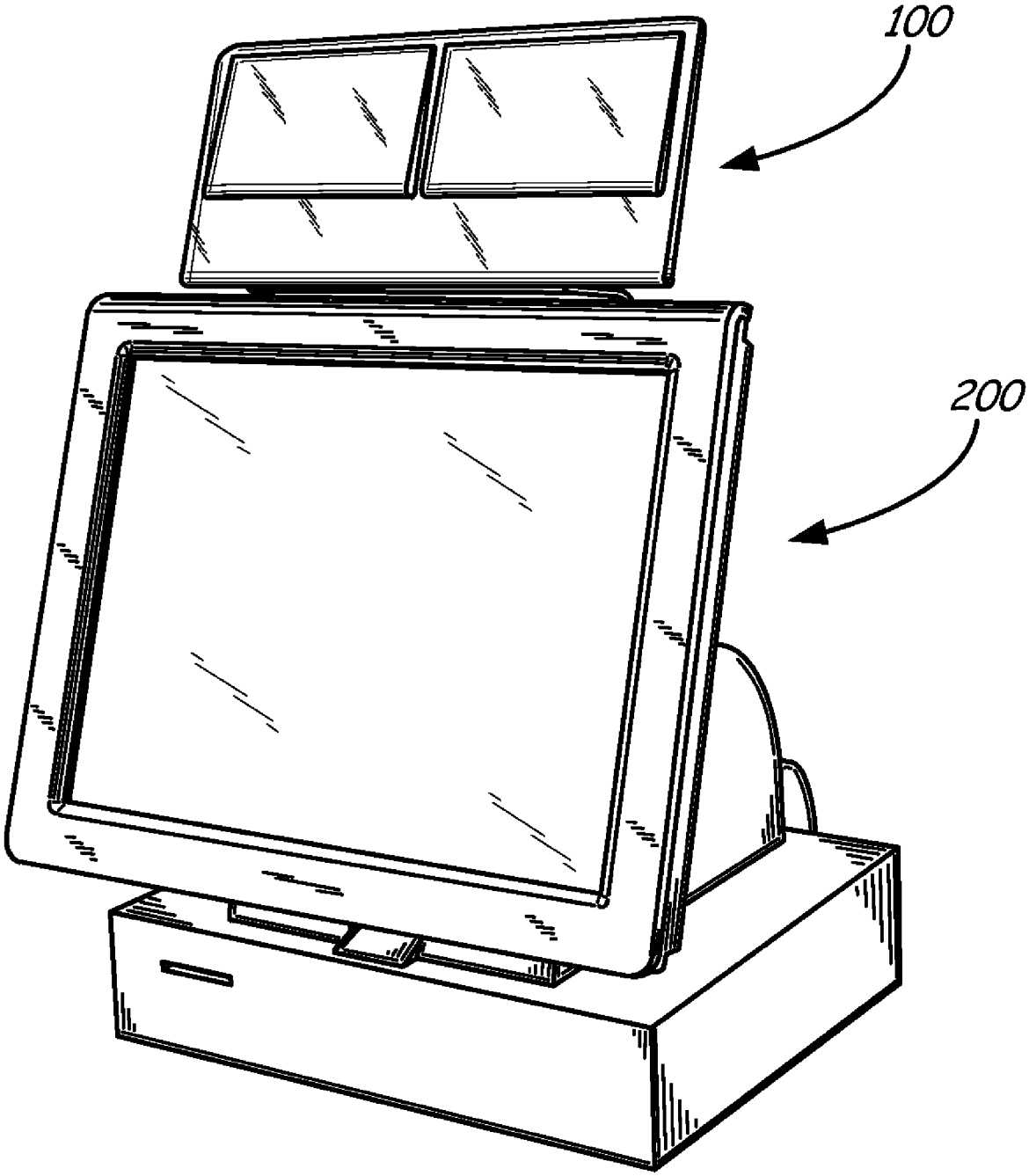
FIG. 15 illustrates a front perspective view of the sign holder illustrated in FIG. 2 mounted to a display device of an electronic kiosk.

FIG. 15 illustrates a perspective view of electronic kiosk 200 including sign holder 100 fully mounted to the electronic kiosk. As illustrated, at least one sign is displayed on electronic kiosk 200 using sign holder 100.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A sign holder comprising:

a base having a mounting portion, a sleeve support portion and a connecting portion coupling the mounting portion to the sleeve support portion, the mounting portion configured to mount to an electronic kiosk;

a first sign sleeve configured to receive at least one first sign and be mounted to a front surface of the sleeve support portion, wherein the first sign sleeve includes an open top, a closed bottom and open sides such that at least one first sign is received by the first sign sleeve through the open top or through either of the open sides;

at least one second sign sleeve configured to receive at least one second sign and be mounted to a front surface of the first sign sleeve;

wherein the at least one second sign sleeve includes a height that is less than a height of the first sign sleeve; and wherein the mounting portion is joined to the connecting portion at a first bend edge and the sleeve support portion is joined to the connecting portion at a second bend edge, the mounting portion and the sleeve support portion being substantially perpendicular to the connecting portion.

2. The sign holder of claim 1, wherein the mounting portion, the sleeve support portion and the connecting portion are made of a single, continuous material.

3. The sign holder of claim 1, wherein the first sign sleeve is mounted to the front surface of sleeve support portion by at least one piece of adhesive.

4. The sign holder of claim 1, wherein the at least one second sign sleeve is mounted to the front surface of the first sign sleeve by at least one piece of adhesive.

5. The sign holder of claim 1, wherein the first sign sleeve comprises a front piece having a top edge, a back piece having a top edge and a bottom connecting piece coupling the front piece of the first sign sleeve to the back piece of the first sign sleeve, the top edges of the front piece and the back piece of the first sign sleeve biasing together, and wherein the at least one second sign sleeve comprises a front piece having a top edge, a back piece having a top edge and a bottom connecting piece coupling the front piece of the at least one second sign sleeve to the back piece of the at least one second sign sleeve, the top edges of the front piece and the back piece of the at least one second sign sleeve biasing together.

6. The sign holder of claim 5, wherein the first sign sleeve receives the at least one first sign between the front piece and back piece of the first sign sleeve and wherein the at least one second sign sleeve receives the at least one second sign between the front piece and the back piece of the at least one second sign sleeve.

7. The sign holder of claim 1, wherein the mounting portion further comprises a pair of downwardly depending tabs that are spaced apart from each other at distal ends.

8. The sign holder of claim 1, wherein the mounting portion further comprises an aperture extending between a front surface and a back surface of the mounting portion.

9. A sign holder comprising:

a backer for mounting to an electronic kiosk and formed of a single, continuous material, the backer including a first bend defining a mounting portion and a connecting portion and a second bend defining the connecting portion and a casing support portion; and a first sign casing configured to receive at least one first sign and be mounted to a front surface of the casing support portion;

wherein the first sign casing includes an open top, a closed bottom and open sides such that the at least one first sign is received by the first sign casing through the open top or through either of the open sides; and wherein the first sign casing further comprises a front piece, a back piece and a bottom connecting piece coupling the front piece to the back piece and wherein top edges of the front piece and the back piece that define the open top of the first sign casing are biased together.

10. The sign holder of claim 9, wherein the first sign casing receives the at least one first sign such that the top edges of the first sign casing bias together to retain the at least one first sign.

11. The sign holder of claim 9, further comprising at least one second sign casing configured to receive at least one second sign and be mounted to a front surface of the first sign casing.

12. The sign holder of claim 11, wherein the at least one second sign casing comprises a front piece having a top edge, a back piece having a top edge and a bottom connecting piece coupling the front piece of the at least one second sign casing to the back piece of the at least one second sign casing, wherein the top edges of the front piece and the back piece of the at least one second sign casing bias together.

13. The sign holder of claim 12, wherein the at least one second sign casing receives the at least one second sign such that the top edges of the front piece and the back piece of the second sign casing bias together to retain the at least one second sign.

14. A method of displaying at least one sign on a kiosk display monitor of an electronic kiosk, the method comprising:

obtaining a sign holder comprising a base having a mounting portion, a sleeve support portion and a connecting portion coupling the mounting portion to the sleeve support portion, wherein the mounting portion is joined to the connecting portion at a first bend edge and the sleeve support portion is joined to the connecting portion at a second bend edge, the mounting portion and the sleeve support portion being substantially perpendicular to the connecting portion;

downwardly sliding a portion of the mounting portion of the base between a back surface of the kiosk display monitor and a support arm supporting the kiosk display monitor so that the sleeve support portion is located above a top surface of the kiosk display monitor; and inserting at least one first sign into a first sign sleeve mounted to a front surface of the sleeve support portion, the first sign sleeve including a front piece having a top edge, a back piece having a top edge and a bottom connecting piece coupling the front piece to the back piece, wherein the top edges of the front piece and the back piece of the first sign sleeve bias together such that the top edges retain the at least one first sign.

15. The method of claim 14, further comprising inserting at least one second sign into an at least one second sign sleeve mounted to a front surface of the first sign sleeve.

16. The method of claim 15, wherein the at least one second sign sleeve comprises a front piece having a top edge, a back piece having a top edge and a bottom connecting piece coupling the front piece of the at least one second sign sleeve to the back piece of the at least one second sign sleeve, wherein the top edges of the front piece and the back piece of the at least one second sign sleeve bias together such that the top edges retain the at least one second sign.

17. The method of claim 15, wherein inserting at least one second sign into the at least one second sign sleeve comprises inserting a respective second sign into each of a pair of second sign sleeves mounted to the front surface of the first sign sleeve.

18. The method of claim 14, wherein the mounting portion comprises a right side edge, a left side edge and a bottom edge, the bottom edge defining distal ends of a pair of downwardly depending tabs, a height of the tabs and a spaced distance between the tabs.

19. The method of claim 18, wherein downwardly sliding the portion of the mounting portion between the back surface of the kiosk display monitor and the support arm supporting the kiosk display monitor comprises downwardly sliding the pair of tabs of the mounting portion between the back surface of the kiosk display monitor and the support arm supporting the kiosk monitor.

* * * * *